US010674243B2

(12) United States Patent
Kargus, IV et al.

(10) Patent No.: US 10,674,243 B2
(45) Date of Patent: Jun. 2, 2020

(54) WIND BREAK FOR EXTERNAL MICROPHONE

(71) Applicant: GM Global Technology Operations LLC, Detroit, MI (US)

(72) Inventors: Walter A. Kargus, IV, Livonia, MI (US); Bassam S. Shahmurad, Rochester Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 16/155,223

(22) Filed: Oct. 9, 2018

(65) Prior Publication Data

US 2020/0112782 A1 Apr. 9, 2020

(51) Int. Cl.
*H04R 1/08* (2006.01)
*H04R 1/04* (2006.01)

(52) U.S. Cl.
CPC ..... *H04R 1/086* (2013.01); *H04R 1/04* (2013.01); *H04R 2410/07* (2013.01); *H04R 2499/13* (2013.01)

(58) Field of Classification Search
None
See application file for complete search history.

(56) References Cited

U.S. PATENT DOCUMENTS 7,848,528 B2 12/2010 Kargus, IV et al.
8,009,852 B2 * 8/2011 Gratke ..... H04R 1/086 381/355
9,508,239 B1 * 11/2016 Harrison ..... G08B 13/2462
2003/0168278 A1 * 9/2003 Solderits ..... G10K 9/22 181/153
2006/0013425 A1 * 1/2006 Kargus, IV ..... H04R 1/086 381/359
2006/0193486 A1 * 8/2006 Kargus, IV ..... H04R 1/086 381/359
2006/0204026 A1 * 9/2006 Kargus, IV ..... H04R 1/086 381/359
2011/0103634 A1 * 5/2011 Maddern ..... H04R 1/086 381/359
2015/0036839 A1 * 2/2015 Cho ..... H04R 1/021 381/86
2019/0114489 A1 * 4/2019 Jackson ..... G06K 9/00805

OTHER PUBLICATIONS

Bruel and Kjaer, Microphone nose cones: UA-0387, UA-0386, UA-0385, and UA-0355, https://www.bksv.com/en/products/transducers/acoustic/Accessories/nose-cones/UA-0387.

* cited by examiner

*Primary Examiner* — Paul W Huber

(57) ABSTRACT

A microphone assembly for an external surface of a vehicle comprises a microphone housing, a microphone assembly, and a wind break member. The microphone housing comprises a housing support. The microphone is disposed in the microphone housing. The wind break member has a base and a wind break portion. The base of the wind break member comprises a floor surface, a leading edge, and a trailing edge opposite the leading edge. The wind break portion of the wind break member is disposed proximate the leading edge of the base. The microphone housing is disposed on the base of the wind break member proximate the wind break portion. The wind break portion comprises a top surface that forms a first angle relative to the base of the wind break member. The top surface has one of a concave shape, a convex shape, and a compound concave and convex shape.

18 Claims, 3 Drawing Sheets

WIND BREAK FOR EXTERNAL MICROPHONE

INTRODUCTION

The present disclosure relates generally to audio devices and more particularly to audio devices for use in automobiles and autonomous vehicles.

Recent developments in automobile controls have increase the requirement for additional input data. One of the additional sources of data includes sound generated from outside the vehicle. In order to capture that data, microphones have been developed to be placed on the exterior of the vehicle. However, as is the case with microphones, they tend to not only pick-up sound that is wanted but also exterior generated noise that is subsequently captured by the microphone.

Accordingly, there is a need in the art for improved external microphones for use on vehicles to improve the quality of the sound captured by the microphone and also reduce the noise generated by the external environment around the microphone.

SUMMARY

The present disclosure comprises a microphone assembly for an external surface of a vehicle, the microphone assembly comprising a flow control housing, a microphone(s), and a wind break member. The microphone housing includes a housing support. The microphone(s) is disposed in the microphone housing. The wind break member has a base and a wind break portion. The microphone housing is disposed on the base of the wind break member proximate the wind break portion.

In one example of the present disclosure, the microphone housing has a partially spherical shape comprising a hollow interior and the microphone is disposed in the hollow interior supported by the housing support.

In another example of the present disclosure, the base of the wind break member comprises a floor surface, a leading edge, and a trailing edge opposite the leading edge. The wind break portion of the wind break member is disposed proximate the leading edge of the base.

In yet another example of the present disclosure, the wind break portion comprises a top surface. The top surface forms a first angle relative to the base of the wind break member and the top surface has one of a concave shape, a convex shape, and a compound concave and convex shape.

In yet another example of the present disclosure, the wind break portion comprises a top surface and an inner surface. The top surface is connected to the inner surface with a contoured edge for preventing the generation of sound.

In yet another example of the present disclosure, the wind break portion comprises a sound path at the base to allow sound to pass through the wind break member. The sound path comprises an inlet and an outlet. The inlet exposes an interior surface of the sound path to the top surface of the wind break portion and the outlet connects the interior surface of the sound path to an inner surface of the wind break portion.

In yet another example of the present disclosure, the microphone assembly further comprises a plurality of heating elements disposed in at least one of the microphone housing, the base of the wind break member, and the wind break portion of the wind break member.

In yet another example of the present disclosure, the floor surface of the base is pitched from the leading edge to the rear edge.

In yet another example of the present disclosure, the wind break member has a circular shape, is concentric about the microphone housing, and comprises a plurality of sound paths disposed between the wind break portion and the base.

The above features and advantages and other features and advantages of the present disclosure are readily apparent from the following detailed description when taken in connection with the accompanying drawings.

BRIEF DESCRIPTION OF THE DRAWING

The drawings described herein are for illustration purposes only and are not intended to limit the scope of the present disclosure in any way.

DESCRIPTION

Figure 1:
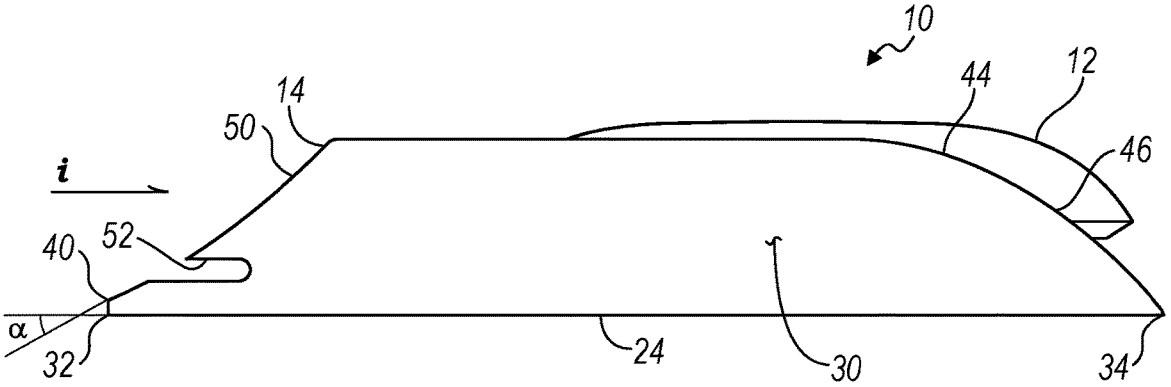
FIG. 1 is a side elevation view of a microphone assembly according to the principles of the present disclosure.
Figure 2A:
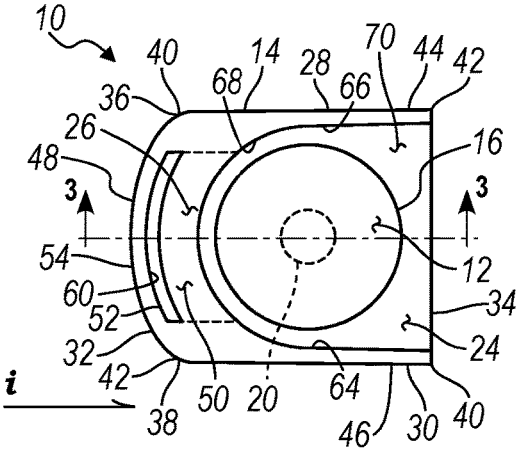
FIG. 2A is a top view of a microphone assembly according to the principles of the present disclosure.
Figure 2B:
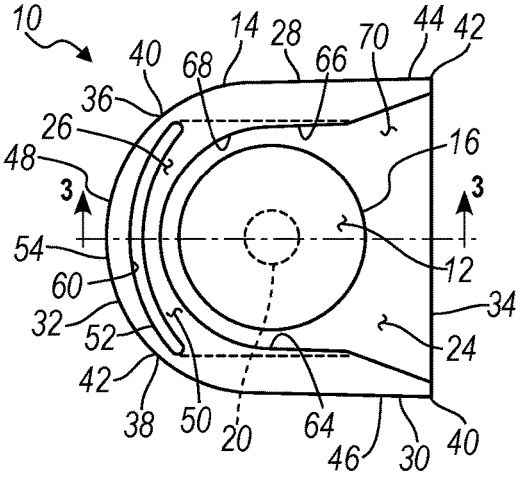
FIG. 2B is a top view of a microphone assembly according to the principles of the present disclosure.
Figure 3:
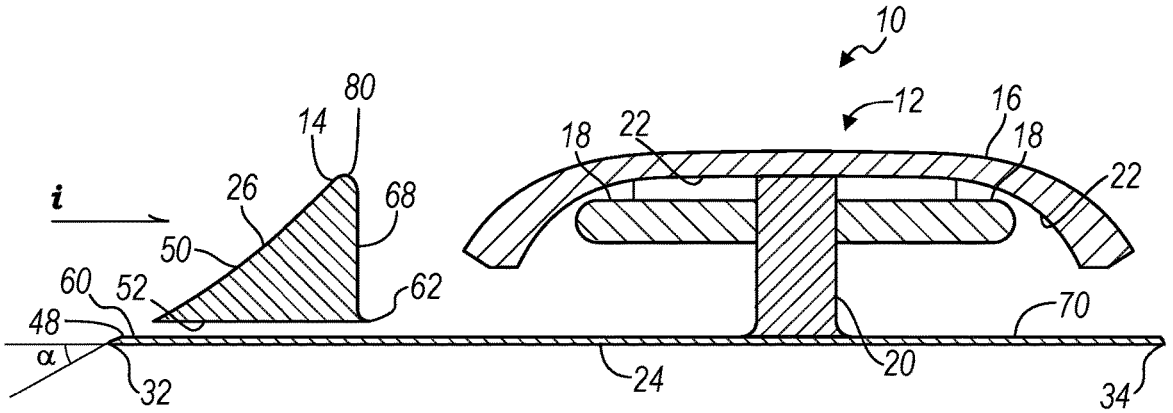
FIG. 3 is a cross section of a microphone assembly according to the principles of the present disclosure.

Examples of the present disclosure advantageously provide a microphone assembly for mounting to the exterior of a vehicle. Referring to the drawings, wherein like reference numbers refer to like components, FIGS. 1-5 illustrate a microphone assembly 10 which will now be described. The microphone assembly 10 includes a flow control housing 12 and a wind break member 14. More particularly, the flow control housing 12 includes a dome 16, a microphone or microphone array 18, and a support post 20. The dome 16 has a dome or partial convex shape and is supported by the support post 20. The microphone 18 is disposed within a hollow interior portion 22 of the dome 16 and is also supported by the support post 20 and the dome 16. The dome 16 controls the flow over the microphone 18 while protecting the microphone 18 from wind, dirt, and precipitation and allowing externally originating sound to pass to the microphone 18. A space is shown separating the microphone 18 from the underside of the dome 22. However, the microphone 18 may be disposed directly adjacent to the dome 22 thereby having no space between the microphone 18 and the dome 22 without departing from the scope of the disclosure.

The wind break member 14 includes a base 24, a curved wind break portion 26, and a first and a second side wall 28, 30. In the present example, the base 24 includes a floor surface 70, a leading edge 32 and a trailing edge 34. The leading edge 32 is aligned on the vehicle such that it is perpendicular to a vector i associated with the oncoming wind as the vehicle is traveling forward. The trailing edge 34 is opposite the leading edge 32 of the base 24. The floor surface 70 of the base 24 is pitched having a higher elevation proximate the leading edge 32 and a lower elevation at the trailing edge 34. The pitched floor surface 70 allows for a drainage path for water when the microphone assembly 10 is otherwise on a level surface. The wind break portion 26 is disposed on the surrounding leading edge 32 of the base 24. The first and second side walls 28, 30 are disposed such that a first end 36, 38 of the first and second side walls 28, 30 is formed to the ends 40, 42 of the wind break portion 26. The wind break portion 26 surrounds the flow control housing 12 going from positions 40 to 42. The first and second side walls 28, 30 include a radius portion 44, 46 that converges to the trailing edge 34 of the base 24.

Figure 6:
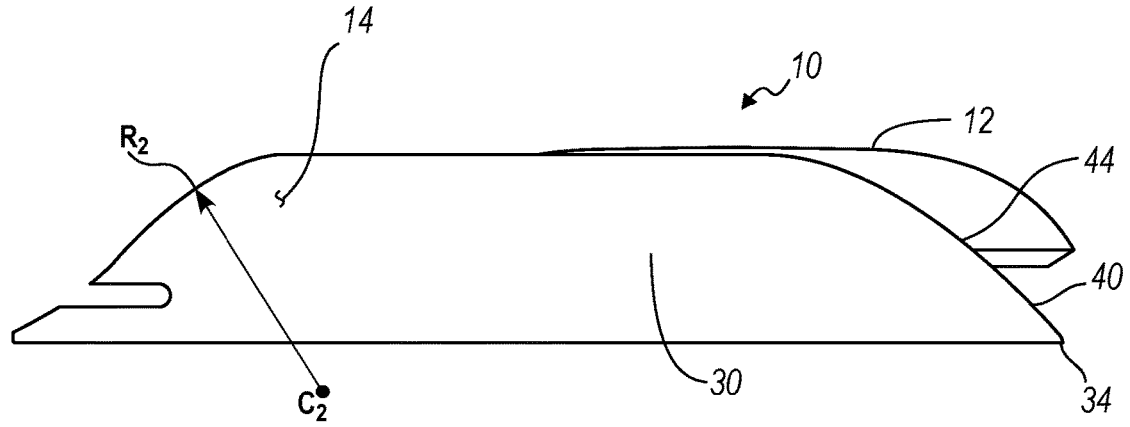
FIG. 6 is a side elevation view of a microphone assembly according to the principles of the present disclosure.

The wind break portion 26 includes a narrow leading edge 48, a sloped top surface 50, an inner surface 68, and an optional sound path 52. The front surrounding edge 48 coordinates with the leading edge 32 of the base 24. In the example shown in FIGS. 2A and 2B, the leading edge 48 has a radius curve 54. However, a wind break portion 26 with a straight leading edge would not depart from the scope of the present disclosure. The top surface 50 includes a starting angle $\alpha$ between the base 24 and the top surface 50 of between 0° and 90°. The top surface 50 as shown in FIGS. 1 and 3-5 includes a convex shape having a first center $c_1$ of the radius of curvature $r_1$ above and forward of the wind break portion 26. Alternatively, as shown in FIG. 6, the top surface 56 has a concave surface 58 including a second center $c_2$ of the radius of curvature $r_2$ below and behind the wind break portion 26. A combination or compound of concave and convex surfaces may also be used without departing from the scope of the disclosure. The top surface 50 transitions to the inner surface 68 of the wind break portion 26 through a contoured edge 80. The optional contoured edge 80 prevents generation of noise and reduces the acoustic scattering of turbulent flow as the air passes from the top surface 50 to the interior of the wind break member 14.

The sound path 52 includes an inlet 60 on one end of the sound path 52 and an outlet 62 on the opposite end. The inlet 60 is disposed proximate the leading edge 32 of the wind break portion 26 and extends from an inner surface 64 of the first side wall 28 to the inner surface 66 of the second side wall 30. The outlet 62 of the sound path 52 opens the interior of the sound path 52 to the inner surface 68 of the wind break portion 26. The sound path 52 provides a pathway for external sound to travel through the wind break portion 26 to the microphone 18 without generating an excessive level of wind noise.

Figure 4:
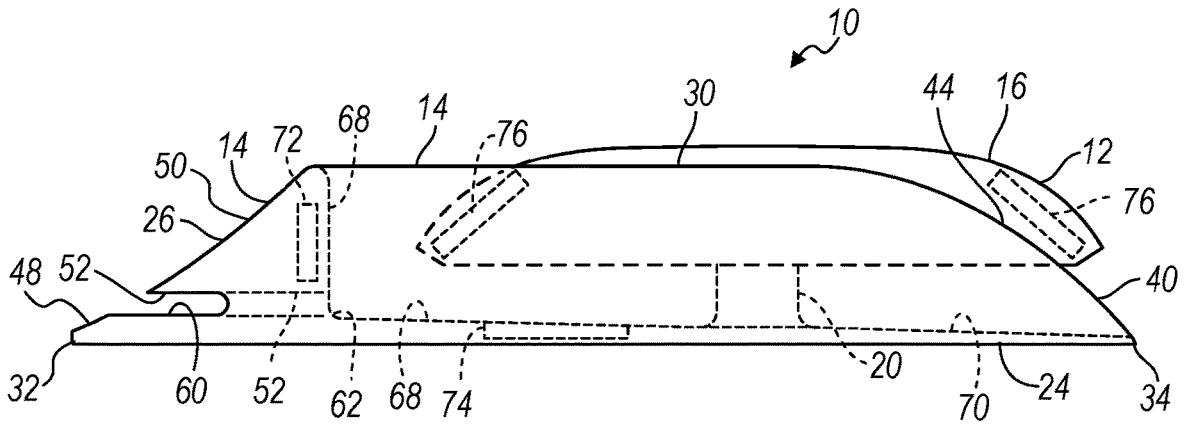
FIG. 4 is a side elevation view of a microphone assembly according to the principles of the present disclosure.
Figure 5:
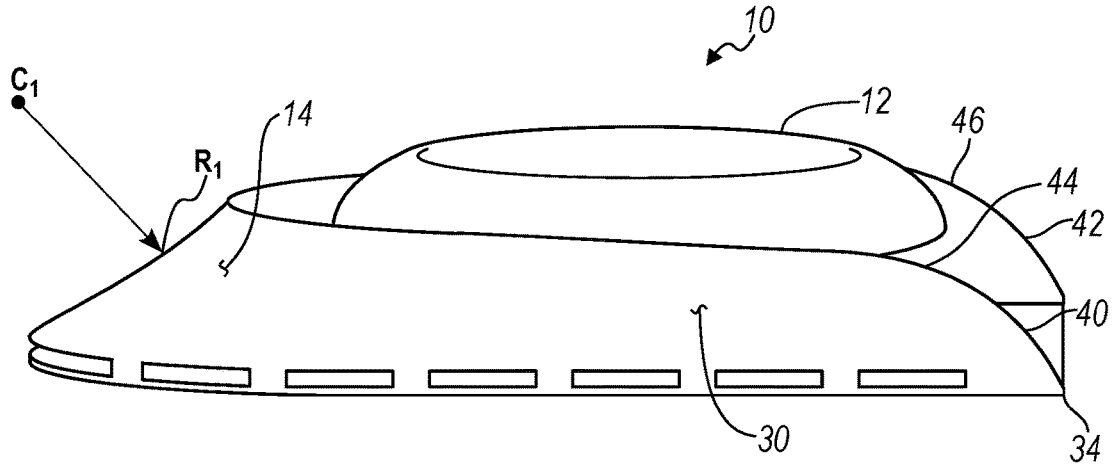
FIG. 5 is a perspective view of a microphone assembly according to the principles of the present disclosure.

Turning with particular reference to FIG. 4, an example of the microphone assembly 10 is shown including a plurality of heating elements. The heating elements are included to melt snow and ice accumulated in and around the microphone assembly 10. A first heating element 72 is disposed in the wind break portion 26 of the wind break member 14. A second heating element 74 is disposed in the base 24 of the wind break member 14. A third heating element 76 is disposed in the flow control housing 12. The heating elements may be hard wired to a power source from the vehicle or they may be powered by a small solar cell and battery incorporated in the microphone assembly 10.

Figure 7:
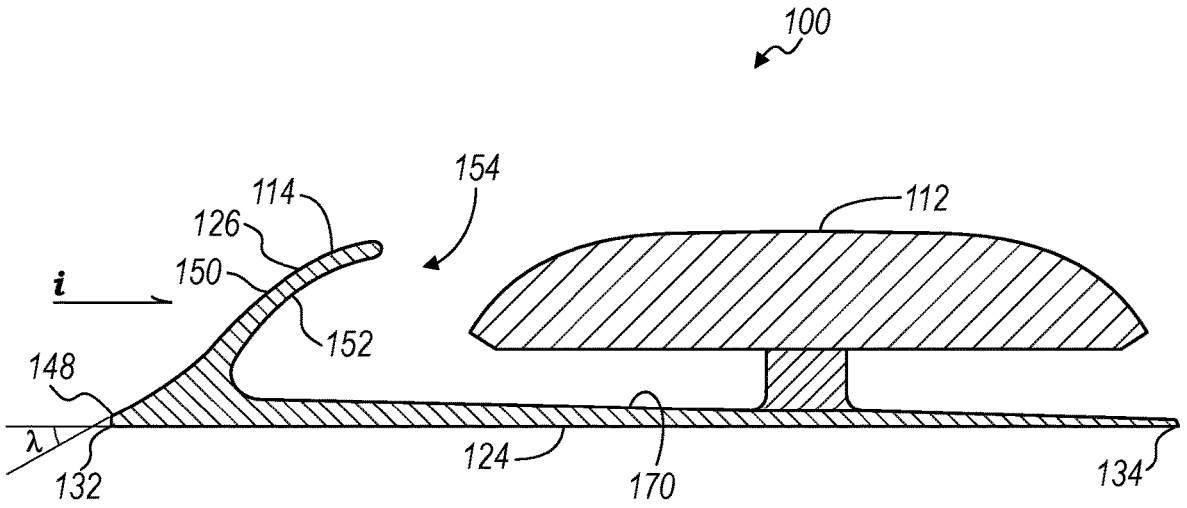
FIG. 7 is a cross section of a microphone assembly according to the principles of the present disclosure.

Turning now to FIG. 7, another example of the microphone assembly 100 is illustrated and will now be described. The microphone assembly 100 includes a microphone housing 112 and a wind break member 114. More particularly, the wind break member 114 includes a base 124 and a curved wind break portion 126. The base 124 includes a floor surface 170, a leading edge 132 and a trailing edge 134. The leading edge 132 is aligned on the vehicle such that it is perpendicular to the front of the vehicle. The trailing edge 134 is opposite the leading edge 132 of the base 124. The floor surface 170 of the base 124 is pitched having a higher elevation proximate the leading edge 132 and a lower elevation at the trailing edge 134. The pitched floor surface 170 allows for a drainage path for water when the microphone assembly 100 is otherwise on a level surface. The wind break portion 126 is disposed on the leading edge 132 of the base 124 and includes a narrow leading edge 148, a sloped top surface 150, and an inside surface 152. The leading edge 148 coordinates with the leading edge 132 of the base 124. The top surface 150 in combination with the base 124 forms an angle A between the base 124 and the top surface 150 of between 0° and 90°. The top surface 150 as shown in FIG. 7 includes a combination of concave and convex shapes. The inside surface 152 predominately follows the contour of the top surface 150 creating a cavity 154 between the wind break portion 126, the microphone 112 and the floor surface 170.

Figure 8:
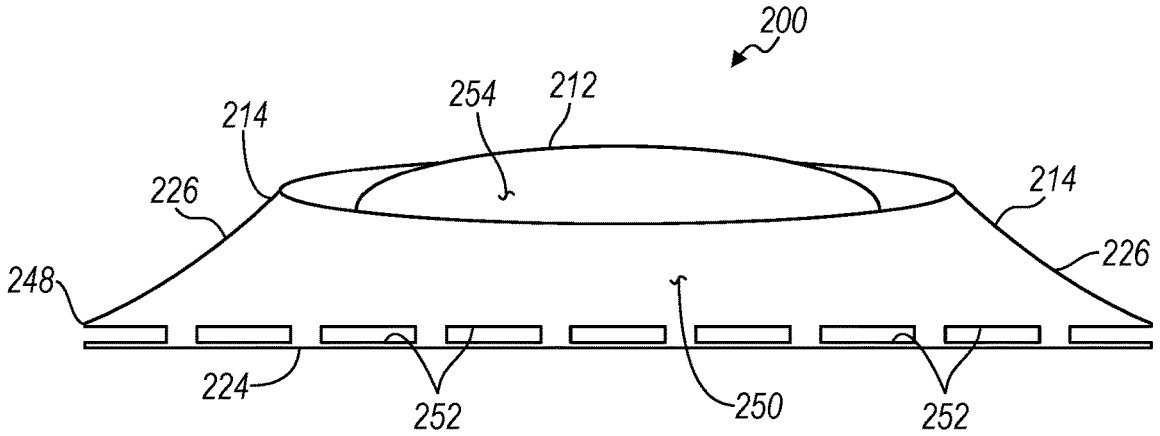
FIG. 8 is a perspective view of a microphone assembly according to the principles of the present disclosure.

Referring now to FIG. 8, another example of the microphone assembly 200 is illustrated and will now be described. The microphone assembly 200 includes a microphone housing 212 and a wind break member 214. More particularly, the wind break member 214 includes a base 224 and a curved wind break portion 226. The wind break member 214 is circular and concentric about the microphone housing 212 and includes an outer edge 248, a plurality of sound paths 252 and a sloped top surface 250. The wind break member 214 is non-directional and deflects airflow from all angles over the top surface 254—of the microphone housing 212. The sound paths 252 are disposed proximate the outer edge 248 allowing for external sound to enter the microphone housing 212 without generating noise. The sound paths 252 also allow for water to drain from inside the wind break member 214.

While examples have been described in detail, those familiar with the art to which this disclosure relates will recognize various alternative designs and examples for practicing the disclosed structure within the scope of the appended claims.

The following is claimed:

1. A microphone assembly for an external surface of a vehicle, the microphone assembly comprising:

a microphone housing comprising a housing support;

a microphone assembly disposed in the microphone housing, and a wind break member having a base and a wind break portion, wherein a floor surface of the base is pitched from a leading edge to a trailing edge of the base; and wherein the microphone housing is disposed behind the wind break member proximate the wind break portion.

2. The microphone assembly of claim 1 wherein the microphone housing has a partially spherical shape comprising a hollow interior and the microphone is disposed in the hollow interior supported by the housing support.

3. The microphone assembly of claim 1 wherein the wind break portion of the wind break member is disposed proximate the leading edge of the base.

4. The microphone assembly of claim 1 wherein the wind break portion comprises a top surface, and wherein the top surface forms a first angle relative to the base of the wind break member and the top surface has one of a concave shape, a convex shape, and a compound concave and convex shape.

5. The microphone assembly of claim 1 wherein the wind break portion comprises a top surface and an inner surface, the top surface is connected to the inner surface with a contoured edge for preventing the generation of sound.

6. The microphone assembly of claim 1 wherein the wind break portion comprises a sound path disposed proximate the base of the wind break member, and wherein the sound path comprises an inlet and an outlet, the inlet exposes an interior surface of the sound path to the top surface of the wind break portion and the outlet connects the interior surface of the sound path to an inner surface of the wind break portion.

7. The microphone assembly of claim 1 further comprising a plurality of heat elements disposed in at least one of the microphone housing, the base of the wind break member, and the wind break portion of the wind break member.

8. The microphone assembly of claim 1 wherein the wind break member, is concentric about the microphone housing, and comprises a plurality of sound paths disposed between the wind break portion and the base.

9. A microphone assembly for an external surface of a vehicle, the microphone assembly comprising:

a microphone housing comprising a housing support;

a microphone assembly disposed in the microphone housing, and a wind break member having a base and a wind break portion, and wherein the base of the wind break member comprises a floor surface, a leading edge, and a trailing edge opposite the leading edge, wherein the floor surface of the base is pitched from the leading edge to the trailing edge of the base, the wind break portion of the wind break member is disposed proximate the leading edge of the base, the microphone housing is disposed on the base of the wind break member proximate the wind break portion, the wind break portion comprises a top surface, the top surface forms a first angle relative to the base of the wind break member, and the top surface has one of a concave shape, a convex shape, and a compound concave and convex shape.

10. The microphone assembly of claim 9 wherein the microphone housing has a partially spherical shape comprising a hollow interior and the microphone is disposed in the hollow interior supported by the housing support.

11. The microphone assembly of claim 10 wherein the wind break portion comprises an inner surface and the top surface is connected to the inner surface with a contoured edge.

12. The microphone assembly of claim 11 wherein the wind break portion comprises a sound path disposed proximate the base of the wind break member, and wherein the sound path comprises an inlet and an outlet, the inlet exposes an interior surface of the sound path to the top surface of the wind break portion and the outlet connects the interior surface of the sound path to an inner surface of the wind break portion.

13. The microphone assembly of claim 12 further comprising a plurality of heat elements disposed in at least one of the microphone housing, the base of the wind break member, and the wind break portion of the wind break member.

14. The microphone assembly of claim 9 wherein the wind break member is concentric about the microphone housing, and comprises a plurality of sound paths disposed between the wind break portion and the base.

15. A microphone assembly for an external surface of a vehicle, the microphone assembly comprising:

a microphone housing comprising a housing support, and wherein the microphone housing has a partially spherical shape having a hollow interior;

a microphone disposed is disposed in the hollow interior of the microphone housing and supported by the housing support, and a wind break member having a base and a wind break portion, and wherein the base of the wind break member comprises a floor surface, a leading edge, and a trailing edge opposite the leading edge, the wind break portion of the wind break member is disposed proximate the leading edge of the base, the microphone housing is disposed on the base of the wind break member proximate the wind break portion, the wind break portion comprises a top surface and an inner surface, the top surface is connected to the inner surface with a contoured edge, the top surface forms a first angle relative to the base of the wind break member, and the top surface has a convex shape and the floor surface of the base is pitched from the leading edge to the trailing edge of the base.

16. The microphone assembly of claim 15 wherein the wind break portion comprises a sound path disposed proximate the base of the wind break member, and wherein the sound path comprises an inlet and an outlet, the inlet exposes an interior surface of the sound path to the top surface of the wind break portion and the outlet connects the interior surface of the sound path to an inner surface of the wind break portion.

17. The microphone assembly of claim 16 further comprising a plurality of heat elements disposed in at least one of the microphone housing, the base of the wind break member, and the wind break portion of the wind break member.

18. The microphone assembly of claim 15 wherein the wind break member is concentric about the microphone housing, and comprises a plurality of sound paths disposed between the wind break portion and the base.

* * * * *